United States Patent [19]

Vukmirovich

[11] 4,115,946

[45] Sep. 26, 1978

[54] FLEXIBLE DISCUS DEVICE

[76] Inventor: Daniel Vukmirovich, 9233 Bedford, Detroit, Mich. 48224

[21] Appl. No.: 759,783

[22] Filed: Jan. 17, 1977

Related U.S. Application Data

[63] Continuation-in-part of Ser. No. 730,179, Oct. 7, 1976, abandoned.

[51] Int. Cl.[2] ..... A63H 33/18

[52] U.S. Cl. ..... 46/74 D; 273/106 B

[58] Field of Search ..... 46/74 D; 273/106.4, 273/DIG. 17; 2/171.2, 195

[56] References Cited

U.S. PATENT DOCUMENTS

| | | | |
|---|---|---|---|
| 1,144,366 | 6/1915 | Levine | 2/195 |
| 1,593,453 | 7/1926 | Hinsen | 273/106 B |
| 3,571,811 | 3/1971 | Wilson | 273/106 B |
| 3,852,910 | 12/1974 | Everett | 46/74 D |

*Primary Examiner*—Louis G. Mancene
*Assistant Examiner*—Robert F. Cutting
*Attorney, Agent, or Firm*—Krass & Young

[57] ABSTRACT

A discus-like hurling toy is formed of a disc of cloth having a gathered and downturned hemmed edge. A string of regularly spaced small metallic weights are fixed within the hem. The device may be worn as a hat or folded or crumpled for storage and when hurled with a rotational motion the centrifugal force acting on the weights extends the device so that it exhibits aerodynamic properties to prolong its flight and give it a true trajectory. Alternative embodiments employ a stranded metal cable and an annular sand bag as weights.

14 Claims, 5 Drawing Figures

FLEXIBLE DISCUS DEVICE

REFERENCE TO RELATED APPLICATIONS

This application is a continuation-in-part of application Ser. No. 730,179, filed Oct. 7, 1976, not abandoned, entitled "Flexible Discus Device".

BACKGROUND OF THE INVENTION

1. Field of the Invention

This invention relates to a disc-shaped toy with a weighted, downturned edged formed of flexible sheet material for use as a hurling toy or a hat.

2. Prior Art

Rigid plastic discus toys have achieved great popularity in recent years. These devices are formed in the shape of large saucers with edge sections that are thickened relative to their central sections. The edges have an extension in a plane normal to the central section to define an upper, convex surface and a lower, concave surface. When the devices are hurled into the air with a twist of the wrist to give them a rotational motion they exhibit aerodynamic properties which prolong their flight and give them true trajectories so that skilled hurlers may exercise control over their flight pattern and duration.

SUMMARY OF THE INVENTION

The present invention is directed toward such a discus-like device which may be readily stored by folding or crumpling without destroying the device, and moreover may be worn as a hat in the manner of a beanie or beret. It is a further object to provide such a device which exhibits the advantageous aerodynamic properties of the previous rigid plastic saucer toys yet is safer to use.

These objects are achieved by formation of the device from a flexible, non-resilient sheet material such as a cloth or a plastic film. The device is formed in the shape of a discus with a flat or slightly domed central section and an edge section or rim which has a projection at right angles to the nominal plane of the central section. A series of small discrete weights, preferably formed of a dense metal such as lead or the like, are affixed to the downturned rim at regular, closely spaced intervals. In alternative embodiments the weights are formed by a stranded cable and an annular sand bag.

The flexible sheet construction allows the device to be folded or simply crumpled into a pocket or to be worn as a hat. When the device is hurled with a rotational motion the centrifugal forces acting on the weights extend the device and give it the aerodynamic properties of the prior art plastic devices. If the device impacts another body during flight it collapses to avoid injury to persons or property.

In a preferred embodiment of the invention, which will subsequently be disclosed in detail, these objects are achieved by forming the device of a flexible, non-resilient sheet material such as a lightweight cloth or a plastic film and fixing a series of small metal weights at regularly spaced points about the downturned rim of the device. The flexible disc and edge does not have either sufficient rigidity or weight distribution to act as the flying disc, but when the device is hurled with the requisite rotational wrist motion centrifugal forces act on the weights and cause them to stretch the sheet material into an extended configuration. The weights also give the device a balance which, along with the extended shape, provides the required aerodynamic properties.

The fact that the weighting is performed by a flexible construction allows the device to have a free edge shape and allows it to be conveniently folded or simply crumpled for storage. It also allows the device to conform to the head of the wearer to function as a cap.

Other objectives, advantages and applications of the present invention will be made apparent by the following detailed description of several embodiments of the invention. The description makes reference to the accompanying drawings in which.

Figure 1:
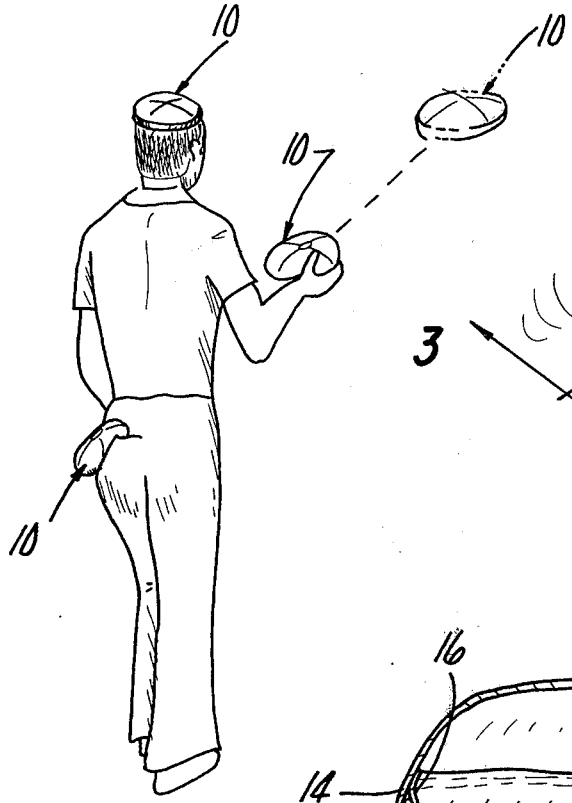
FIG. 1 is a perspective view of a user employing three specimens of a preferred embodiment of the invention: wearing a first as a cap; hurling a second; and carrying a third in a trouser pocket.
Figure 2:
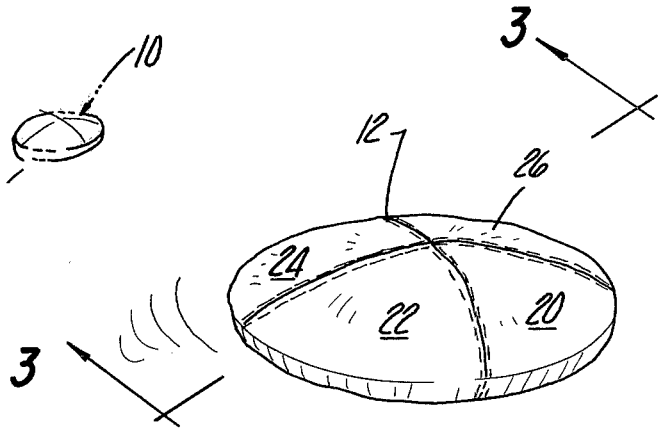
FIG. 2 is a perspective view of one of the devices of FIG. 1 in flight.
Figure 3:
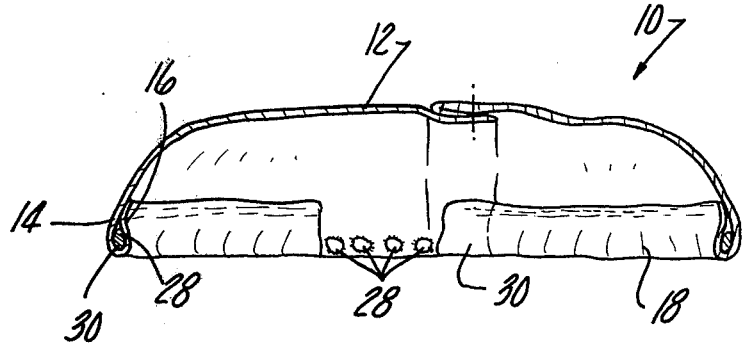
FIG. 3 is a sectional view through the devices of FIGS. 1 and 3, partly broken away for purposes of illustration.

Referring to FIGS. 1–3, a preferred embodiment of the present device is generally indicated at 10. The body of the device is preferably formed of a fabric woven from fibers such as cotton, various synthetic fibers such as polyester and the like, or combinations of the two. In alternative embodiments of the invention the body of the device could be formed of a sheet of film plastic, preferably of a type that does not take a permanent set or crease when crumpled.

The body material must be light in weight and non-resilient so that it may be easily folded or crumpled but will not permanently crease.

The device is formed with a central disc-shaped section 12 having an edge section 14 that is hemmed at 16 and gathered around its periphery at 18, so as to have an extension normally to the general plane of the central section 18 when the device is extended. The hemmed section 16 is sewn or otherwise suitably formed about the edge.

The central section 12 of the device 10 is slightly domed when extended. This may be achieved by forming the device out of four pie-shaped sections 20, 22, 24 and 26 and sewing them together at their perimeters, with a slight overlap, which increases toward the edge, to give the device the desired curvature.

A string of small weights 28 are supported at closely spaced intervals within the hemmed section 16. The weights are preferably formed of a metal, such as lead, that has a substantially higher density than the fabric. The weights are relatively small, such as a quarter of an inch in diameter, and are secured at spaced points along the hemmed edge, by encasing them in a fabric sleeve 30, and sewing the sleeve within the hem. The weights may be spaced by about one-quarter to one inch intervals.

The entire device preferably has a diameter of between about six and fourteen inches. This makes it suitable for use as a beanie or beret, as illustrated in FIG. 1. The device may also be crumpled or folded for insertion in a pocket as illustrated in FIG. 1.

When the device is hurled with a rotational motion, preferably with its hemmed edge 14 facing downwardly, the centrifugal forces acting on the weights 28 stretch the device into an extended shape and give it aerodynamic properties which prolong its flight and provide it with a true trajectory. The device may be used as a hurling toy and has the additional advantage of collapsing when impacting a body and thus providing it with an added degree of safety.

Figure 4:
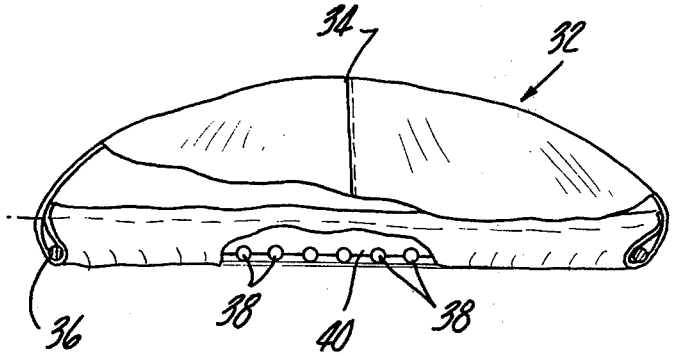
FIG. 4 is a sectional view of a first alternative embodiment of the device.

An alternative embodiment of the device, generally indicated at 32 in FIG. 4, has a curved dome-shaped midsection 34 and a downturned edge 36 that is not gathered but is smoothly formed from the midsection by suitably weaving or stretching the fabric. A plurality of weights 38, supported within the hemmed edge 36 are retained on a string 40 in the manner of beads on a necklace.

Figure 5:
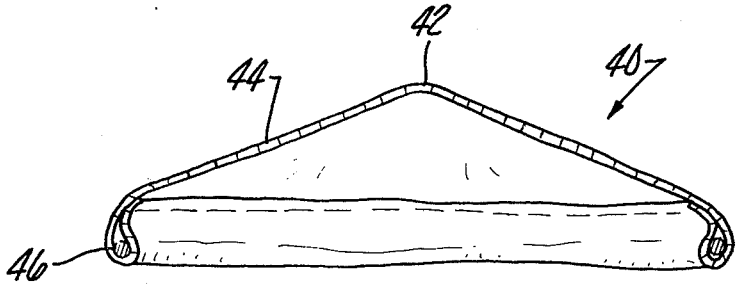
FIG. 5 is a sectional view through a second alternative embodiment of the device.

Another alternative embodiment, generally indicated at 40 in FIG. 5 is formed generally conically, with a central peak 42 and flat sloping sides 44 meeting in the peak. The downturned hemmed edge 46 extends normally to the nominal plane of the conical section 44. Other concave-convex shapes may be used in alternative embodiments of the invention.

In the embodiment of FIG. 5 the weight 10 is continuous rather than discrete, and is formed of a stranded flexible steel cable 48. The cable has sufficient flexibility so as to not interfere with folding of the device and the cable does not take a set.

Alternatively, the cable 48 could be replaced by sand filling the channel formed within the hemmed edge 46. The sand should fully fill the channel so that it does not shift within the channel. In general, the weight must be of distributed form and must have a density substantially in excess of that of the sheet material.

The embodiments of the invention in which an exclusive property or privilege is claimed are defined as follows:

1. A device comprising a disc-shaped section of flexible, non-resilient sheet material having an edge section with an extension in a direction normal to the nominal plane of the disc when the sheet and edge section are extended, and an annular distributed weight formed of a material having a density substantially in excess of the sheet material connected to said laterally extending edge, whereby the device may be readily folded or crumpled, and when hurled with a rotational motion the centrifugal forces acting on the weights will cause the device to assume an extended position so as to exhibit aerodynamic properties.

2. The device of claim 1 wherein the disc-shaped section has a substantially planar configuration when extended.

3. The device of claim 1 wherein the disc-shaped section is formed so that when extended the center of the disc is displaced from the edge of the disc laterally with respect to the nominal plane of the disc.

4. The device of claim 1 in which the disc-shaped section and the edge are formed of a common sheet, with a gathered hem formed about the edge.

5. The device of claim 4 wherein the distributed weight is secured within the hem.

6. The device of claim 1 wherein the disc-shaped section and the edge are formed of a plurality of pie-shaped sections of sheet material joined to one another along radially extending lines.

7. The device of claim 6 wherein the edges of the pie-shaped sections are sewn one to another.

8. The device of claim 1 wherein the disc has a diameter of between 6 and 14 inches so as to be suitable to be worn as a hat.

9. The device of claim 1 wherein the distributed weight takes the form of a plurality of discrete elements secured about the laterally extending edge of the device.

10. The device of claim 1 wherein the annular distributed weight takes the form of a stranded cable.

11. The device of claim 1 wherein the annular distributed weight takes the form of a fine particulate material separated within a hem formed about the edge of the sheet.

12. The device of claim 11 wherein the particulate material is sand.

13. The device of claim 1 in which the weights are formed of metal.

14. The device of claim 13 wherein the distributed weights are strung together on a flexible, non-resilient line.

* * * * *